US005499939A

United States Patent [19]

Itoh et al.

[11] Patent Number: 5,499,939

[45] Date of Patent: Mar. 19, 1996

[54] EVACUATION APPARATUS

[75] Inventors: Shigeo Itoh; Mikio Yokoyama; Takeshi Tonegawa; Akira Kadowaki, all of Mobara, Japan

[73] Assignee: Futaba Denshi Kogyo K.K., Mobara, Japan

[21] Appl. No.: 360,284

[22] Filed: Dec. 21, 1994

[30] Foreign Application Priority Data

Dec. 22, 1993 [JP] Japan ..... 5-345608

[51] Int. Cl.[6] ..... H01J 9/385

[52] U.S. Cl. ..... 445/73; 445/70; 141/65

[58] Field of Search ..... 445/70, 73; 141/65

[56] References Cited

U.S. PATENT DOCUMENTS 2,730,280 1/1956 Spencer ..... 445/73

FOREIGN PATENT DOCUMENTS 48-13437 4/1973 Japan ..... 445/73

56-168321 12/1981 Japan ..... 445/73

2-234326 9/1990 Japan ..... 141/65

*Primary Examiner*—P. Austin Bradley

*Assistant Examiner*—Jeffrey T. Knapp

*Attorney, Agent, or Firm*—Oblon, Spivak, McClelland, Maier, & Neustadt

[57] ABSTRACT

An evacuation apparatus is capable of evacuating an envelope to a high vacuum without evacuating a whole room or chamber to a high vacuum. An evacuation pipe is connected at a distal end thereof to an evacuation head and a vacuum pump is actuated to evacuate an evacuation chamber to a high vacuum, to thereby evacuate an envelope to a high vacuum. Then, a motor is driven to rotate ball screws, to thereby upwardly move the envelope mounted on the evacuation head. The evacuation pipe is fused at an intermediate portion thereof by a gas burner, to thereby be sealed. Then, the evacuation pipe is cut to disconnect the envelope from the evacuation head.

4 Claims, 6 Drawing Sheets

EVACUATION APPARATUS

BACKGROUND OF THE INVENTION

This invention relates to an evacuation apparatus for a display device which is adapted to evacuate an envelope for the display device to a high vacuum, and more particularly to an evacuation apparatus which permits sealing and evacuation of the envelope of the display device to be consistently carried out.

Formation of a vacuum hermetic container for a display device such as a fluorescent display device or the like by sealing and evacuation is carried out by preliminarily calcining an envelope for the vacuum hermetic container, sealing the envelope in an inert gas atmosphere, evacuating the envelope through an evacuation section of the envelope to form a vacuum in the envelope and sealing the evacuation section, to thereby provide the vacuum hermetic container.

The above-described step of preliminarily calcining the envelope is executed at a calcination temperature of 200° to 500° C. to decompose an organic component of a sealing material. The sealing step is carried out at a calcination temperature of 300° to 600° C. to restrain generation of gas from a sealing material in an inert gas atmosphere, to thereby seal the envelope while pressedly holding the envelope by means of a clip or the like. Then, the envelope is evacuated to a high vacuum while being baked at a temperature which does not lead to re-melting of the sealing material, followed by sealing of the evacuation section.

The above-described steps may be carried out according to a chamber system wherein all the steps are in a single chamber or an in-line system wherein the steps are carried out in a plurality of rooms which are separated from each other through gate valves depending on an atmosphere and a temperature and through which the envelope is transferred by means of a carrier unit. Alternatively, a system may be employed which is adapted to carry out the sealing step and evacuation step in different units, respectively, wherein evacuation is carried out through the evacuation section and the remaining part of the envelope is exposed to an ambient atmosphere.

Conventionally, the evacuation section is constructed in two ways. In one of the ways, the evacuation section includes an exhaust pipe. In the other way, the evacuation section includes an evacuation hole comprising a through-hole formed via the envelope.

Now, the evacuation section of the latter type will be described hereinafter with reference to FIG. 5. An envelope 100 is formed by sealedly joining a front substrate 101 and a rear substrate 102 to each other through side substrates 103. An evacuation pipe 104 is arranged so as to communicate with an inner space of the envelope 100 and be led out of the the rear substrate 102. Evacuation of the envelope 100 is carried out through the evacuation pipe 104, which is then sealed by fusion.

The evacuation section of the former type is constructed in such a manner as shown in FIG. 6. An envelope 100 is formed by sealedly joining a front substrate 101 and a rear substrate 102 to each other through side substrates 103, like the envelope 100 shown in FIG. 5. Evacuation of the envelope 100 is carried out through an evacuation hole formed via the rear substrate 102 so as to communicate with an interior of the envelope 100 and then the evacuation hole 106 is sealedly covered with a lid 107 having an oxide solder 108 deposited thereon by fusing the solder.

Now, an in-line system for the sealing and evacuation which is disclosed in Japanese Patent Publication No. 39174/1992 by the assignee will be described with reference to FIG. 7.

First, a box-like casing formed by sealedly mounting side substrates on a front substrate is arranged on a rear substrate and is transferred to a preliminary calcination chamber 120 while pressedly holding the box-like envelope and rear substrate by means of a fixture such as a clip or the like for the purpose of forming an envelope. The preliminary calcination chamber 120 is provided therein with a heating unit, resulting in being kept at a temperature of 200° to 300° C. The calcination chamber 120 may have an ambient atmosphere introduced thereinto. Alternatively, it may have oxidizing gas introduced thereinto in order to carry out the preliminary calcination with increased efficiency. In the preliminary calcination chamber 120, an organic component contained in an oxide solder deposited on a sealing section of the envelope is fully subject to oxidation, resulting in being evaporated.

Upon completion of the preliminary calcination, a gate valve 121 is rendered open, so that a tray on which the envelope is put is guided to a gas substitution chamber 122 by a transfer unit. In the gas substitution chamber 122, gas therein is evacuated therefrom by means of a rotary pump 123 to cause gas in the envelope to be attendantly evacuated and then inert gas such as nitrogen gas, argon gas, carbon dioxide gas or the like is fed from an inert gas source 126 to the gas substitution chamber 122, to thereby cause the envelope to be charged with the inert gas.

Subsequently, the gate valve 124 is rendered open and the tray is transferred to the sealing furnace chamber 125. In the sealing furnace chamber 125, the envelope is heated to 300° to 600° C. in an inert gas atmosphere, so that the oxide solder deposited on the sealing section of the envelope is melted. The envelope is pressedly held by the fixture as described above, resulting in the front substrate and rear substrate being sealedly joined together. The sealing furnace chamber 125 is fed with inert gas from the inert gas source 126, to thereby prevent chemical change of cathodes and phosphors arranged in the envelope. Also, the feeding of the inert gas permits the whole envelope to be uniformly heated, to thereby substantially prevent generation of bubbles from the oxide solder.

The envelope thus sealed is then transferred to a slow cooling chamber 127 which is charged with the same inert gas as that of the sealing furnace chamber 125, in which the envelope is slowly cooled to a temperature of 200° to 400° C., so that the oxide solder is changed from a molten state to a solid state. The slowly cooled envelope is transferred to a roughing vacuum chamber 128 through gate valves 129 and 130 kept open by means of the transfer unit. The gate valve 129 is provided for heat sealing and the gate valve 130 is provided for vacuum formation. When the tray is transferred to the roughing vacuum chamber 128, a rotary pump 131 is operated to evacuate the chamber 128 to a low vacuum. When the chamber is thus evacuated to a predetermined vacuum, the gate valve 132 is rendered open, resulting in the tray being transferred to a main vacuum chamber 133. The main vacuum chamber 133 is kept evacuated to a high vacuum, so that even when a degree of vacuum due to opening of the gate valve 132 is reduced, operation of a diffusion pump 136 permits the main vacuum chamber 133 to be evacuated to a high vacuum in a short period of time. The main vacuum chamber 133 permits the envelope to be evacuated to a high vacuum. Then, a gate valve 135 is rendered open, so that the tray is transferred to a sealing chamber 134.

In the sealing chamber 134, the envelope is heated, so that gas is apt to be generated from the envelope. Concurrently, the diffusion pump 136 is kept actuated to evacuate the sealing chamber 134 to a high vacuum. Then, an evacuation pipe is sealed by fusion or an evacuation hole is sealed by melting an oxide solder deposited on a lid.

Thus, the envelope thus evacuated to a high vacuum is then transferred to a cooling chamber 138 through a gate valve 137 rendered open, followed by slow cooling in the cooling chamber 138. The envelope thus cooled is transferred to a takeoff chamber 140, in which it is further cooled and returned to an ambient pressure by leakage, followed by removal from the takeoff chamber 140.

The envelope removed from the takeoff chamber 140 is subject to gettering and aging, resulting in being completed.

Unfortunately, the in-line system described above requires evacuating a whole single room to a high vacuum, to thereby take a great deal of time for evacuation and a large-size installation for evacuation, resulting in deteriorating evacuation efficiency.

Also, evacuation of the whole single room to a high vacuum causes heat conduction in the atmosphere of the room to be deteriorated so as to render uniform heating for baking the envelope difficult, and thereby fail to fully carry out gas emission.

Further, the chamber system has problems as in the in-line system because it requires to evacuate the whole chamber in which evacuation and sealing are carried out to a high vacuum.

SUMMARY OF THE INVENTION

The present invention has been made in view of the foregoing disadvantage of the prior art.

Accordingly, it is an object of the present invention to provide an evacuation apparatus which is capable of evacuating an envelope for a display device to obtain a high vacuum without evacuating a whole room or chamber.

It is another object of the present invention to provide an evacuation apparatus which is consistently accomplishing a sealing step and an evacuation step.

In accordance with the present invention, an evacuation apparatus is provided. The evacuation apparatus comprises a chamber which has a desired atmosphere or a vacuum atmosphere formed therein and in which envelopes for vacuum airtight containers are held, an evacuation head arranged for holding each of the envelopes in the chamber and formed at a central portion thereof with a through section connected to an evacuation unit, a drive unit arranged for accessing the evacuation head to an evacuation section of the envelope, and a seal member arranged around the evacuation head so as to isolate an interior of the chamber and an exterior thereof from each other, whereby evacuation of the envelope to a high vacuum is carried out from the evacuation section through the evacuation head by the evacuation unit.

In a preferred embodiment of the present invention, the evacuation section of the envelope is formed into a tubular shape and the evacuation head is provided at a distal end thereof with a connection which is connected through a seal member to the tubular evacuation section.

The evacuation apparatus of the present invention constructed as described above permits an envelope for a display device to be evacuated to a high vacuum without evacuating a whole room or chamber to a high vacuum.

Also, the present invention carries out evacuation of the envelope toga high vacuum without making the evacuation apparatus large-size, to thereby carry out the evacuation with high efficiency and reduce the operating cost.

Further, application of the present invention to the in-line system permits surplus heat generated from a heater during a sealing step to be utilized directly for heating during an evacuation step, to thereby increase energy efficiency and substantially reduce thermal strain from the envelope. In addition, the sealing step and evacuation step are continuously carried out, to thereby prevent contamination of the envelope between the steps, resulting in the quality of a finished product being rendered uniform and stabilized. Also, this reduces the time required for the evacuation, to thereby improve productivity.

BRIEF DESCRIPTION OF THE DRAWINGS

These and other objects and may of the attendant advantages of the present invention will be readily appreciated as the same becomes better understood by reference to the following description when considered in connection with the accompanying drawings; wherein.

DESCRIPTION OF THE PREFERRED EMBODIMENTS

Now, the present invention will be described hereinafter with reference to FIGS. 1 to 4.

Figure 1:
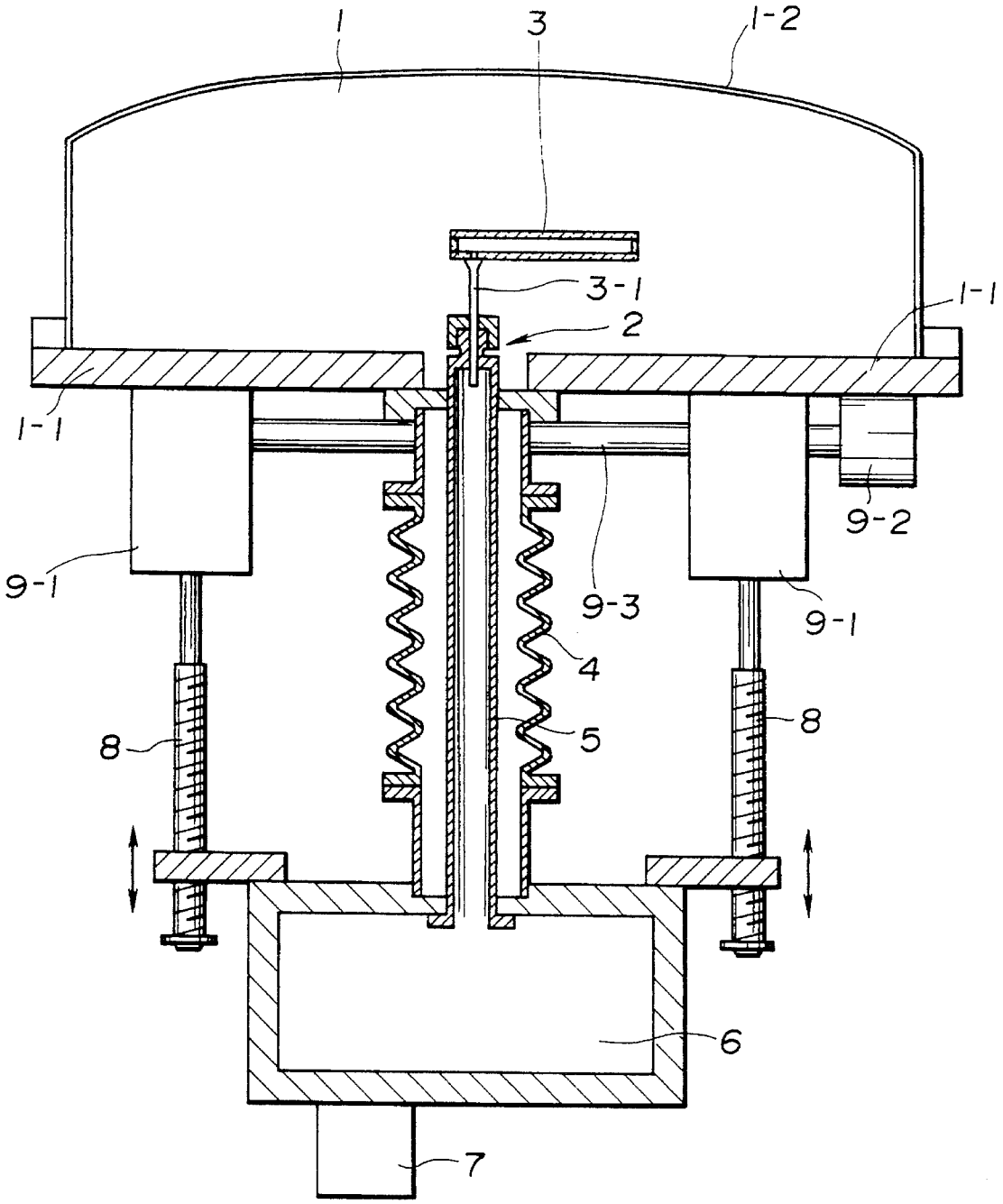
FIG. 1 is a schematic view showing an embodiment of an evacuation apparatus according to the present invention.

Referring first to FIG. 1, a first embodiment of an evacuation apparatus according to the present invention is illustrated. An evacuation apparatus of the illustrated embodiment is applied to a chamber system, wherein preliminary calcination, sealing, slow cooling and sealing/evacuation of an envelope are carried out in order in a chamber and the envelope is evacuated to a high vacuum by means of an exhaust pipe of the envelope.

A chamber designated at reference numeral 1 is defined by a chamber bottom plate 1-1 and a cover 1-2 arranged so as to be openable with respect to the chamber bottom plate 1-1. The chamber 1 is adapted to be evacuated to a low vacuum by means of a vacuum pump (not shown). The chamber bottom plate 1-1 is formed with a plurality of through-holes or openings, in which evacuation heads 2 provided on a distal end of cylinders 5 are airtightly arranged in a manner to be retractable with respect to the openings, respectively.

Reference numeral 3 designates envelopes 3 each of which is provided with an evacuation pipe 3-1. The evacuation pipe 3-1 of each of the envelopes 3 is airtightly connected to a distal end of each of the evacuation heads 2, so that the envelope 3 communicates through the evacuation pipe 3-1 with an interior of each of the cylinders 5. The cylinders 5 are commonly fixedly connected at a lower end thereof to an evacuation chamber 6 while communicating with the evacuation chamber 6, which is adapted to be evacuated to a high vacuum by means of a vacuum pump 7.

In order to ensure the above-described retractable arrangement of the evacuation heads 2, the evacuation chamber 6 is arranged so as to vertically movable. More particularly, the evacuation chamber 6 is threadedly provided on both sides thereof with ball screws 8, resulting in upwardly or downwardly being moved depending on a direction of rotation of the ball screws 8. The ball screws 8 are operatively connected to worm gear boxes 9-1, respectively. The worm gear boxes 9-1 each are provided therein with a war gear, which is coupled to a revolving shaft of a motor 9-2, so that driving force of the motor 9-2 is transmitted to the worm gear. The worm gear boxes 9-1 are rotatably connected to each other through a connection rod 9-3, so that the ball screws 8 may be concurrently rotated in the same direction.

In the evacuation apparatus of the first embodiment constructed as described above, when the motor 9-2 is turned on, the driving force of the motor is transmitted through the worm gear boxes 9-1 to the ball screws 8, to thereby rotate the ball screws 8, resulting in the evacuation chamber 6 threadedly connected to the ball screws 8 being vertically moved or upwardly or downwardly moved depending on a direction of rotation of the ball screws 8. Thus, each of the cylinders 5 fixedly connected to the evacuation chamber 6 is vertically moved depending on vertical movement of the evacuation chamber 6, so that the evacuation head provided on the distal end of each of the cylinders 5 is correspondingly vertically moved. As will be noted from the foregoing, the evacuation chamber 6 has a plurality of the cylinders 5 fixedly connected thereto and the evacuation head 5 is provided at the distal end of each of the cylinders 5. In FIG. 1, only one cylinder 5 is illustrated for the sake of brevity. The cylinders 5 are each are surrounded by a bellows 4 arranged around the cylinder 5.

The evacuation chamber 6, the motor 9-2 and the worm gear boxes 9-1 and the like arranged below the bottom plate 1-1 are enclosed by a cover (not shown), in which a space is evacuated to a low vacuum.

Now, the manner of operation of the evacuation apparatus of the illustrated embodiment will be described hereinafter. First, the cover 1-2 is rendered open and a plurality of envelopes 3 are received in the chamber 1. Then, the envelopes 3 each are mounted on each of the evacuation heads 2. Thereafter, preliminary calcination and gas substitution are carried out on the envelopes in substantially the same manner as described above in connection with the prior art. Then, the envelopes 3 are each heated using a heater in an inert atmosphere to melt an oxide solder deposited on the envelope, leading to sealing of the envelope. Thereafter, the evacuation pipe 3-1 mounted on each of the envelopes 3 is connected to each of the evacuation heads 2. Connection between each of the envelopes 3 and the corresponding evacuation heads 2 is detailedly shown in FIG. 2.

Figure 2:
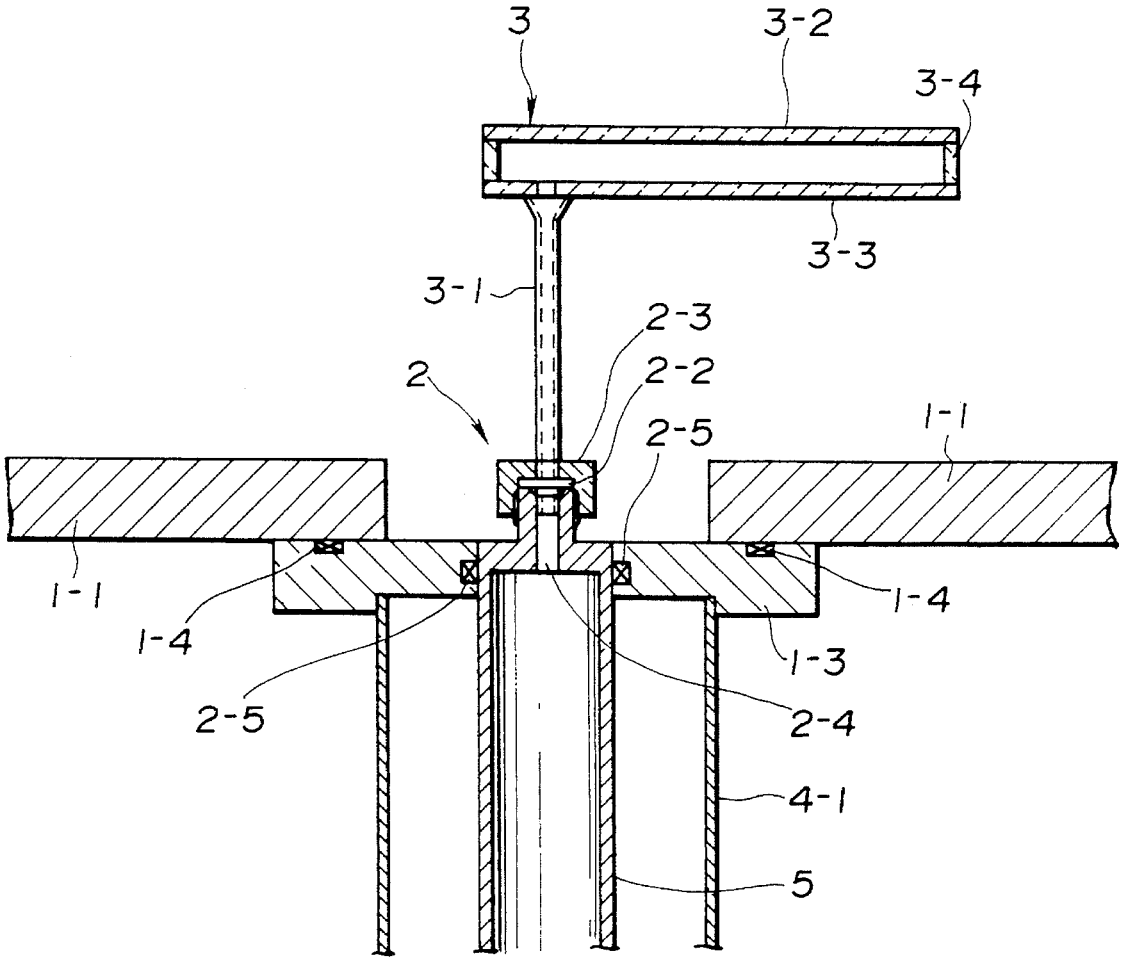
FIG. 2 is a sectional view showing an evacuation head incorporated in the evacuation apparatus of FIG. 1.
Figure 5:
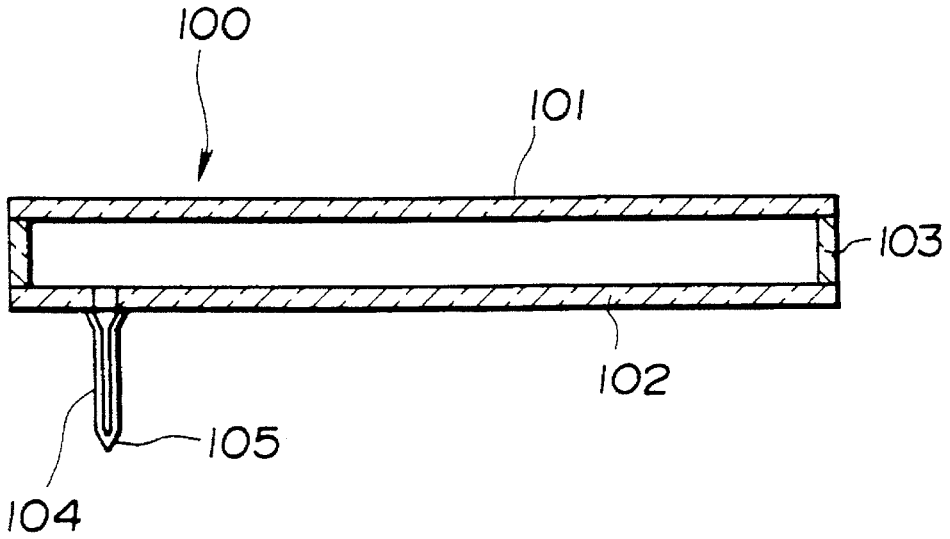
FIG.5 PRIOR ART
FIG. 5 is a sectional view showing a conventional envelope including an evacuation pipe.

In FIG. 2, the envelope 3 is constructed so as to be directed to a fluorescent display device. The envelope 3 includes a front substrate 3-2 and a rear substrate 3-3 arranged so as to be opposite to each other and sealedly joined to each other through side substrates 3-4 in substantially the same manner as the prior art shown in FIG. 5. The rear substrate 3-3 has the evacuation pipe 3-1 sealedly connected thereto in a manner to communicate with an interior of the envelope 3. The evacuation pipe 3-1 is connected at a distal end thereof to a distal end of the evacuation head 2. The distal end of the evacuation head 2 is reduced in diameter and formed thereon with threads, on which a nut 2-3 is threadedly fitted. The nut 2-3 is provided therein with an O-ring 2-2, so that rotation of the nut 2-3 while keeping the distal or lower end of the evacuation pipe 3-1 inserted into the nut 2-3 and a through-hole 2-4 of the evacuation head 2 permits the distal end of the evacuation pipe 3-1 to be airtightly connected to the evacuation head 2.

The bellows 4 has a connection pipe 4-1 connected thereto, which is mounted on a mount 1-3 fixed on the bottom plate 1-1. A seal 1-4 is arranged between the bottom plate 1-1 and the mount 1-3 to keep airtightness therebetween. The vertically movable cylinder 5 is inserted through a through-hole of the mount 1-3 while keeping airtightness therebetween through a seal 2-5.

When the vacuum pump 7 (FIG. 1) is actuated to evacuate the evacuation chamber 6 to a high vacuum while keeping the distal end of the evacuation pipe 3-1 connected to the evacuation head 2, evacuation of the envelope 3 is carried out through the cylinder 5, evacuation head 2 and evacuation pipe 3-1 communicating with the evacuation chamber 6 in order, so that a high vacuum is formed in the envelope 3. Upon completion of evacuation of the envelope 3 to a high vacuum, the motor 9-2 is driven to rotate the ball screws 8 through the worm gear boxes 9-1, to thereby upwardly move the evacuation chamber 6. This causes each of the cylinder 5 to be lifted, resulting in the evacuation head 2 mounted on the distal end of the cylinder 5 and the envelope 2 connected to the evacuation head 2 being concurrently lifted.

Then, the cover 1-2 is released from the bottom plate 1-1 and then the evacuation pipe 3-1 is melted at an intermediate portion thereof by means of a gas burner, resulting in being sealed by fusion. Subsequently, the sealed evacuation pipe 3-1 is cut to disconnect the envelope 3 from the evacuation head 2. Thereafter, the remaining portion of the evacuation pipe 3-1 is removed from the evacuation head 2 and then the next envelope 3 is connected to the evacuation head 2, followed by repeating of the above-described operation. This results in the envelopes sealed and evacuated being successively provided.

The illustrated embodiment may be so constructed that the chamber 1 is provided therein with a holding section for holding the envelope 3 to not only cause the evacuation head 2 to automatically grasp or clamp the evacuation pipe 3-1 of the envelope 3 but automatically release the evacuation head 2 from the evacuation pipe 3-1. Such construction permits the evacuation head 2 to retreat from the chamber 1 during the preliminary calcination and sealing steps.

Figure 3:
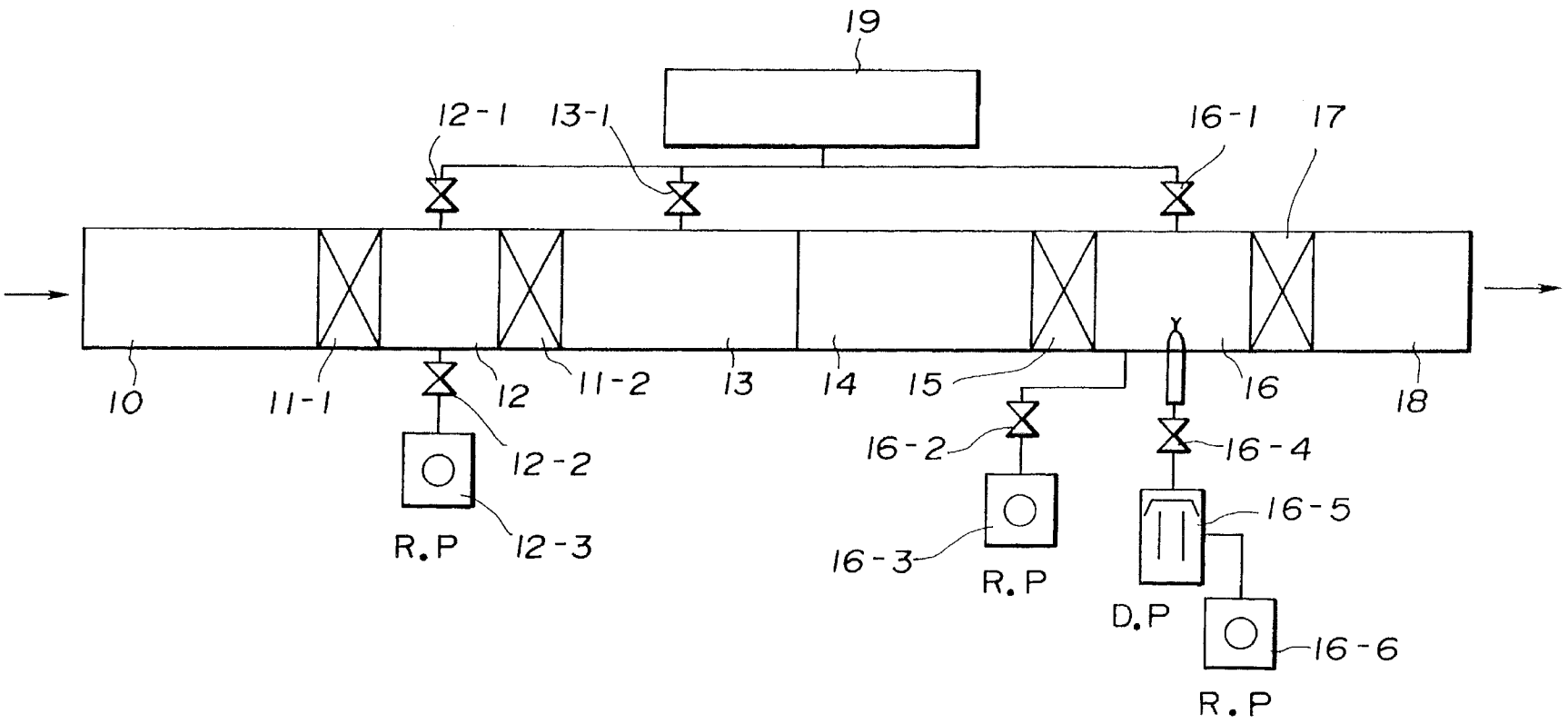
FIG. 3 is a diagrammatic view showing an in-line system to which the evacuation apparatus shown in FIG. 1 is applied.

Referring now to FIG. 3, a second embodiment of an evacuation apparatus according to the present invention is illustrated, which is applied to an in-line system wherein steps of sealing and evacuating an envelope are consistently practiced.

First, a box-like casing formed by sealedly mounting side substrates on a front substrate is arranged on a rear substrate and then transferred to a preliminary calcination chamber 10 while pressedly holding the box-like envelope and rear substrate together by means of a fixture such as a clip or the like for the purpose of forming an envelope. The preliminary calcination chamber 10 is provided therein with a heating unit, resulting in being kept at a temperature of 200° to 300°

C. by the heating unit. The preliminary calcination chamber 10 may have an ambient atmosphere introduced thereinto. Alternatively, it may have an oxidizing gas atmosphere introduced thereinto in order to carry out preliminary calcination of the envelope with increased efficiency. In the preliminary calcination chamber 10, an organic component contained in an oxide solder deposited on a sealing section of the envelope is fully subject to oxidation, resulting in being evaporated.

Upon completion of the preliminary calcination, a gate valve 11-1 is opened, so that a tray on which the envelopes are put is guided to a gas substitution chamber 12 by a transfer unit. In the gas substitution chamber 12, the gas located therein is evacuated therefrom by means of a rotary pump 12-3 to cause gas in the envelope to be attendantly evacuated and then inert gas such as nitrogen gas, argon gas, carbon dioxide gas or the like is fed from an inert gas source 19 to the gas substitution chamber 12 through a valve 12-1 rendered open, to thereby cause the envelope to be charged with the inert gas.

Subsequently, the gate valve 11-2 is opened and the tray is transferred to a sealing chamber 13. In the sealing chamber 13, the envelopes each are heated to 300° to 600° C. in an inert gas atmosphere or a vacuum atmosphere, so that the oxide solder deposited on the sealing section of the envelope is melted. The envelope is vertically pressedly held by the fixture as described above, resulting in the front substrate and rear substrate being sealedly joined together by melting of the oxide solder. The sealing chamber 13 is fed with inert gas from an inert gas source 119, to thereby prevent chemical change of cathodes and phosphors received in the envelope for forming a fluorescent display device.

The envelopes thus sealed each are then transferred to a slow cooling chamber 14 which is charged with the same inert gas as that of the sealing chamber 13, in which the envelope is slowly cooled to a temperature of 200° to 400° C., so that the oxide solder is changed from a molten state to a solid state. The slowly cooled envelopes are transferred to an evacuating/sealing chamber 16 through a gate valve 15 kept open by means of the transfer unit. When the tray is transferred, a rotary pump 16-3 is actuated to evacuate evacuating/sealing chamber 16 to a low vacuum. When the evacuating/sealing chamber 16 is evacuated to a predetermined degree of vacuum, a diffusion pump 16-5 and a rotary pump 16-6 arranged so as to communicate with an evacuation head airtightly connected to each of the envelopes are actuated, to thereby evacuate the envelope to a high vacuum. In this instance, each of the envelope is heated, to thereby be apt to emit gas. In this connection, some of heat which has been applied during the sealing step still remains in the envelope, resulting in heating of the envelope being facilitated. After each of the envelopes is thus evacuated to a high vacuum, an evacuation hole of the envelope is sealedly closed with a lid member. Then, after the envelope is slowly cooled, the gate valve 16 is rendered open, so that the tray may be transferred to a takeoff chamber 18. When each of the envelopes is further cooled, it is returned to an atmospheric pressure by leakage, followed by removal of the envelope from the takeoff chamber 18.

The envelope removed from the takeoff chamber 18 is subject to gettering and aging, to thereby be completed.

The envelope thus sealed and evacuated has a cathode and a phosphor previously incorporated therein, to thereby provide a fluorescent display device.

Figure 4:
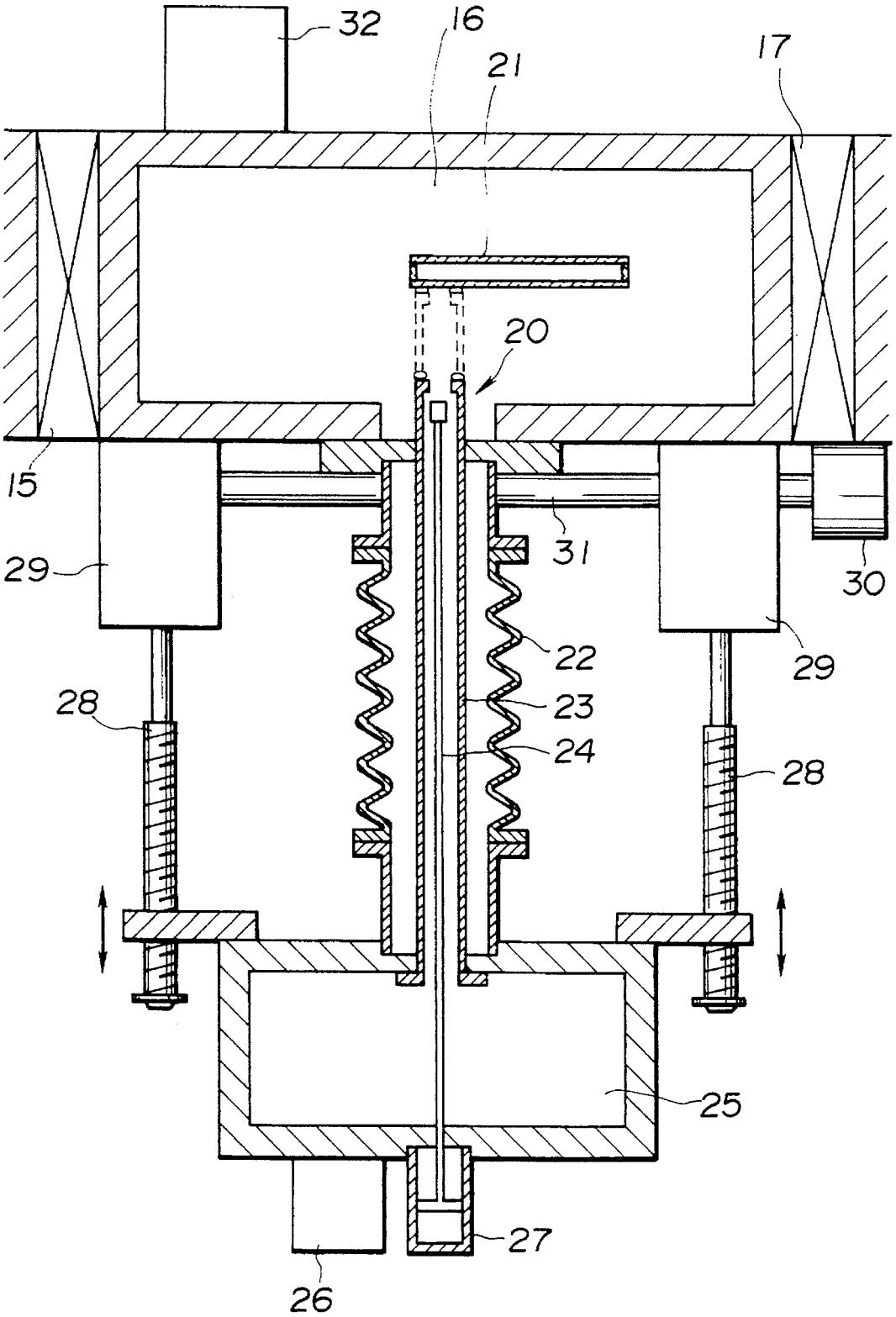
FIG. 4 is a sectional view showing a second embodiment of an evacuation apparatus according to the present invention.
Figure 6:
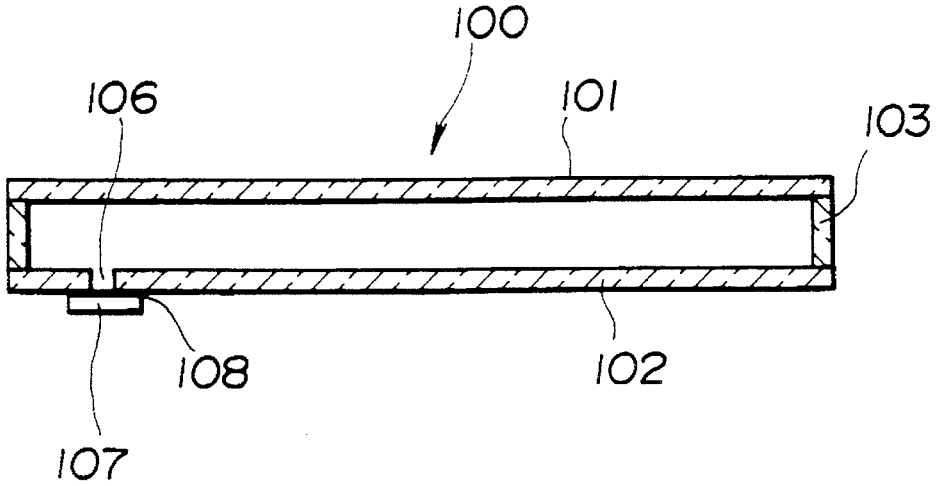
FIG.6 PRIOR ART
FIG. 6 is a sectional view showing a conventional envelope including an hole.
Figure 7:
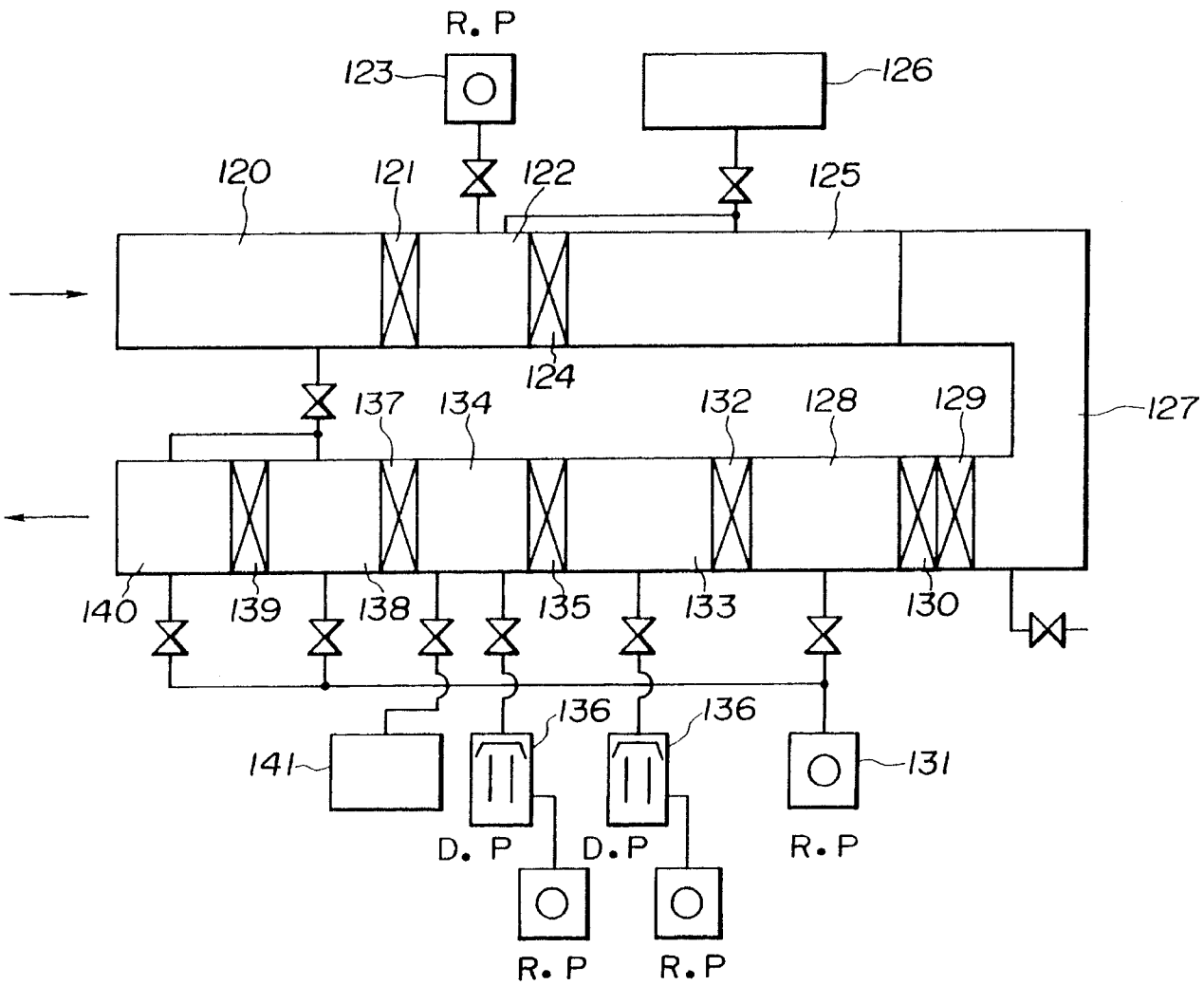
FIG.7 PRIOR ART
FIG. 7 is a diagrammatic view showing a conventional in-line system.

The second embodiment of the present invention is featured by the sealing/evacuating chamber 16. Now, the evacuating/sealing chamber 16 will be described more detailedly with reference to FIG. 4, wherein each of the envelopes includes an evacuation section constituted by an evacuation hole comprises such a through-hole as employed in the prior art described above with reference to FIG. 6. Thus, evacuation of the envelope designated at reference numeral 21 in FIG. 4 is carried out through the evacuation hole.

The evacuating/sealing chamber 16 shut off by the gate valve 15 and a gate valve 17 is evacuated to a low vacuum by means of a vacuum pump 32. The evacuating/sealing chamber 16 is formed on a bottom thereof with a plurality of through-holes or openings, in which evacuation heads 20 each provided on a distal end of a cylinder 23 are arranged in a retractable manner, respectively.

Also, the evacuation heads 20 each are intimately contacted with the evacuation hole of each of the envelopes, so that airtightness between the evacuation head and the evacuation hole may be ensured and the cylinder is permitted to communicate through the evacuation head with the envelope 21. The cylinders 23 are commonly securely connected at a lower end thereof to an evacuation chamber 25 in a manner to communicate with the evacuation chamber 25. The evacuation chamber 25 is evacuated to a high vacuum by means of the vacuum pump 26.

The evacuation chamber 25 is constructed so as to be vertically movable, to thereby ensure the above-described arrangement of the evacuation head 2 in a retractable manner. More particularly, the evacuation chamber 25 is provided with ball screws 28, which are arranged on both sides of the evacuation chamber 25 and threadedly engaged therewith, so that the evacuation chamber 25 is selectively upwardly or downwardly moved depending on a direction of rotation of the ball screws 28. The ball screws 28 are operatively connected to worm gear boxes 29 each including a worm gear, respectively. The worm gear of each of the worm gear boxes 29 is coupled to a revolving shaft of a motor 30, so that driving force of the motor 30 is transmitted to the worm gears and therefore the worm gear boxes 29. The worm gear boxes 29 are rotatably connected to each other through a connection rod 31, so that the ball screws 28 may be concurrently rotated in the same direction.

When the motor is turned on, to thereby be driven, driving force of the motor 30 is transmitted through the worm gear boxes 29 to the ball screws 28, resulting in the ball screws 28 being rotated in the same direction, so that the evacuation chamber 25 is selectively upwardly or downwardly moved. This causes the cylinders 23 commonly connected to the evacuation chamber 25 to be likewise upwardly or downwardly moved in correspondence to the movement of the evacuation chamber 25, leading to upward or downward movement of the evacuation head 20 provided at the distal end of each of the cylinders 23. As will be noted from the foregoing, a plurality of the cylinders 25 are connected to the evacuation chamber 25. In FIG. 4, only one such cylinder 23 is illustrated for the sake of brevity. The cylinders 23 each are surrounded by a bellows 22 arranged around the cylinder 23.

The cylinders 23 each have a rod 24 inserted thereinto, which is provided at a distal end thereof with a heater having a lid member fitted thereon. The rod 24 is arranged in a manner to be retractable or accessible to the evacuation head 2. Thus, after each of the envelopes 21 is evacuated to a high vacuum, the rod 24 is upwardly moved to pressedly contact the lid member with the evacuation hole of the envelope 21 and then the heater is turned on, so that an oxide solder deposited on the lid member may be melted to seal the evacuation hole by fusion.

In order to ensure the above-described accessible or retractable arrangement of each of the rods 24, the evacuation chamber 25 is provided on a lower side thereof with a cylinder 27, in which a piston provided on a lower end of the rod 24 is movably received so as to be vertically moved, for example, by pneumatic pressure.

The evacuation chamber 25, the motor 30, and the worm gear boxes 29 and the like arranged below the evacuating/sealing chamber 16 are surrounded by a cover (not shown), in which a space is evacuated to a low vacuum.

In the evacuation apparatus of the illustrated embodiment, the gate valve 15 is opened, resulting in a plurality of the envelopes 21 being received in the evacuating/sealing chamber 16 and then the heater is turned on to melt the oxide solder of each of the envelopes in an inert gas atmosphere, resulting in sealing of each of the envelopes 21 being carried out, during which the evacuation head 20 is held at a position below the evacuating/sealing chamber 16, to thereby be kept from being heated by the heater. Upon completion of the sealing, the evacuation heads 20 each are upwardly moved, to thereby be intimately contacted with the evacuation hole of each of the envelopes 21.

Then, the vacuum pump (FIG. 4) is actuated to evacuate the evacuation chamber to a high vacuum while keeping each of the envelopes 21 intimately contacted with the corresponding evacuation head 20, so that evacuation of the envelope 21 is carried out through the corresponding cylinder 23, evacuation head 20 and evacuation hole communicating with the evacuation chamber 25 in order. Thereafter, air is introduced into the cylinder 27 under pressure to upwardly move the rod 24, so that the lid member fitted on the heater provided on the distal end of the rod 24 is pressedly contacted with the envelope 21 to close the evacuation hole of the envelope 21. Then, the heater is turned on to melt the oxide solder deposited on the lid member, so that the evacuation hole is sealed by the lid member. Subsequently, the heater is turned off, resulting in the oxide solder being changed from a molten state to a solid state, leading to completion of sealing of the envelope.

Upon completion of the sealing, the motor 30 is driven to rotate the ball screws 28 through the worm gear boxes 29, to thereby lower the evacuation chamber 25. This causes each of the cylinders 23 to be likewise lowered, so that the evacuation head 20 at the distal end of the cylinder 23 is downwardly disconnected from the envelope 21. Then, the gate valve 17 is rendered open the envelope 21 is transferred through the gate valve 17 to the takeoff chamber 18. Subsequently, the gate valve 15 is rendered open to transfer the next envelope 21 to the evacuating/sealing chamber 16.

Thus, the second embodiment permits surplus heat generated by the heater during the sealing step to be utilized directly for heating the envelope during the evacuation step, to thereby increase energy efficiency and substantially reduce thermal strain from the envelope. In addition, the sealing and evacuation are continuously carried out, to thereby prevent contamination of the envelope between the steps, resulting in quality of the finished envelope being rendered uniform and stabilized. Also, this reduces time required for the evacuation, to thereby improve productivity.

The evacuation apparatus of the second embodiment may be applied to such a chamber system as described above.

The above description has been made in connection with the envelope in the form of a vacuum hermetic container for a fluorescent display device. However, the envelope of the present invention may be conveniently applied to a vacuum hermetic container for other display devices.

As can be seen from the foregoing, the present invention permits the envelope to be evacuated to a high vacuum without evacuating a whole room or chamber. Also, the present invention ensures evacuation of the envelope to a high vacuum without making the evacuation apparatus large-sizing.

Further, the present invention permits surplus heat generated by the heater during the sealing step to be utilized directly for heating the envelope during the evacuation step, to thereby increase energy efficiency and substantially reduce thermal strain from the envelope. In addition, the sealing and evacuation are continuously carried out, to thereby prevent contamination of the envelope between the steps, resulting in quality of the finished envelope being rendered uniform and stabilized. Also, this reduces time required for the evacuation, to thereby improve productivity.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An evacuation apparatus comprising:

a chamber which has a desired atmosphere or a vacuum atmosphere formed therein and in which envelopes for vacuum airtight display device containers are held;

an evacuation head holding each of said envelopes in said chamber wherein said evacuation head is located at a central portion of said chamber with a through section connecting said evacuation head to an evacuation unit;

a drive unit accessing said evacuation head to an evacuation section of said envelope; and a seal member arranged around said evacuation head so as to isolate an interior of said chamber and an exterior thereof from each other;

whereby evacuation of the envelope to a high vacuum is carried out from said evacuation section through said evacuation head by said evacuation unit.

2. An evacuation apparatus as defined in claim 1, wherein said evacuation section of said envelope is formed into a tubular shape; and said evacuation head is provided at a distal end thereof with a connection which is connected through said seal member to said tubular evacuation section;

said evacuation section and said evacuation head communicating with each other while keeping said tubular evacuation section connected to said connection.

3. An evacuation apparatus as defined in claim 1 or 2, wherein said chamber constitutes a part of rooms contiguous to each other which are separated from each other through openable gate valves and is constructed so as to be movable between the rooms together with a holder on which said envelope is held.

4. An evacuation apparatus as defined in claim 1 or 2, wherein said chamber includes a detachable cover and said envelope detachably held on said evacuation head.

* * * * *